United States Patent [19]

Pavone

[11] 4,318,946

[45] Mar. 9, 1982

[54] DECORATIVE SIMULATED STAINED GLASS LIGHT TRANSMISSIVE MOSAIC PANELS

[76] Inventor: Dallas Pavone, 6361 Beechmont Ave., Cincinnati, Ohio 45230

[21] Appl. No.: 89,915

[22] Filed: Oct. 31, 1979

[51] Int. Cl.[3] ..... B44F 1/06

[52] U.S. Cl. ..... 428/34; 52/311; 156/63; 428/38

[58] Field of Search ..... 428/38; 156/63; 52/311

[56] References Cited

U.S. PATENT DOCUMENTS

| | | | |
|---|---|---|---|
| 2,095,402 | 10/1937 | Stark, Jr. | 428/38 |
| 2,105,265 | 1/1938 | Reilly | 428/38 |
| 2,592,258 | 4/1952 | Economakis | 428/38 |
| 3,183,140 | 5/1965 | Gibson, Jr. | 428/38 |
| 3,247,046 | 4/1966 | Fazekas | 428/38 |
| 3,306,956 | 2/1967 | Barnette | 428/38 X |
| 3,420,728 | 1/1969 | Haverstock | 428/38 |
| 3,460,303 | 8/1969 | Algrain et al. | 428/38 X |
| 3,504,470 | 4/1970 | Pincemin | 428/49 X |
| 3,560,315 | 2/1971 | Evans et al. | 428/50 |
| 3,854,267 | 12/1974 | Weiant | 428/49 X |

*Primary Examiner*—Henry F. Epstein
*Attorney, Agent, or Firm*—Frost & Jacobs

[57] ABSTRACT

A decorative simulated stained glass light transmissive mosaic panel comprising a plurality of unequally spaced irregularly shaped colored members of methyl methacylate positioned on the upper surface of a thin rigid light transmissive planar support sheet of methyl methacylate, and held in place by a light transmissive bonding agent. The members are bonded to the sheet at their periphery to form a central void or air space between the member and the sheet to improve the thermal insulating properties of the panel. A thermally non-conductive opaque latex grouting fills the areas between the members to a level slightly lower than the upper surfaces of the members to form a pleasing stained glass-like effect. The appearance of one or more of the colored members may be modified by a layer of colored dye applied to the upper surface of the members. One or more light refractive or reflective members may be added to the upper surface of the colored members and a light transmissive image-bearing film may be laminated between light transmissive members to provide an aesthetically pleasing effect.

18 Claims, 9 Drawing Figures

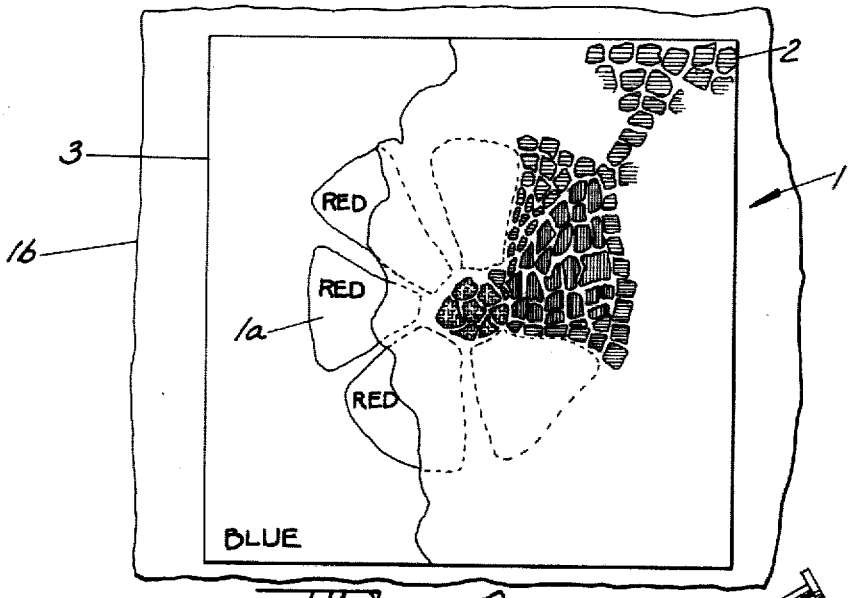
FIG. 1
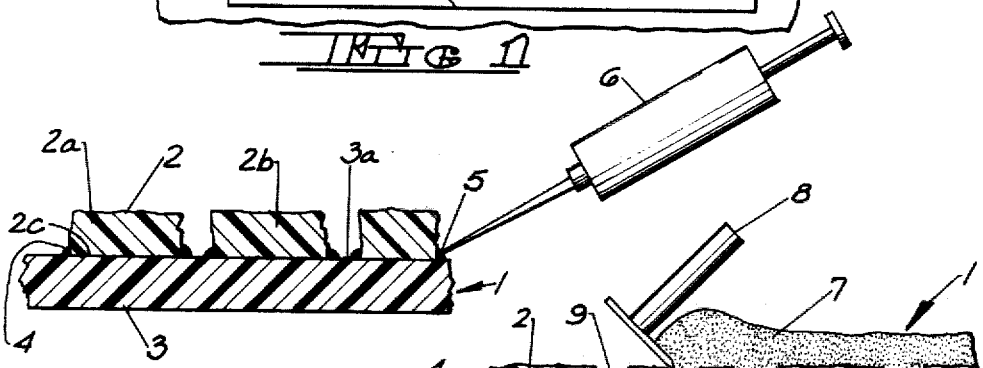
FIG. 2A
FIG. 3
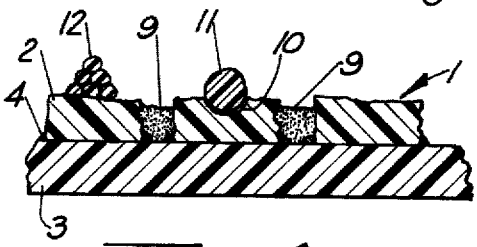
FIG. 4
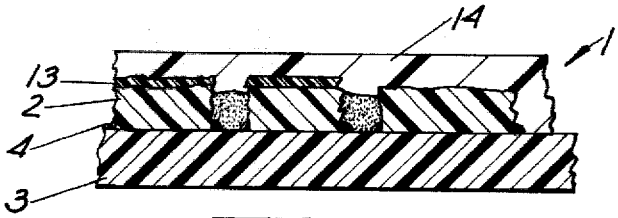
FIG. 5

DECORATIVE SIMULATED STAINED GLASS LIGHT TRANSMISSIVE MOSAIC PANELS

SUMMARY OF THE INVENTION

The art of fabricating decorative conventional leaded colored or stained glass windows has been known for many centuries. In such windows, accurately measured pieces or panes of colored glass are arranged in a decorative pattern, often employing a religious motif, and are held in place by a lattice formed by individual lead bars soldered to each other and containing grooves into which the edges of the glass pieces are inserted. Such stained glass windows require a high degree of skill to design and construct, and are generally quite expensive. Furthermore, applications requiring large stained glass windows generally require the windows to be fabricated and erected in small segments. Alternatively, the large windows may be held in place by iron bars or the like to impart greater rigidity to the window, which often seriously impairs the aesthetic appearance of the stained glass windows.

The present invention is directed to a decorative simulated stained glass light transmissive mosaic panel which can be used to construct windows of significantly larger size than conventionally possible with stained glass windows. A panel may also be used for other types of applications such as lighted ceilings or door sidelights. One important application for the panels of the present invention is as decorative lighted dance floors which require significant load bearing strength and wear resistance.

In a preferred embodiment, a plurality of irregularly shaped plate-like differently colored light transmissive methyl methacylate pieces or members are arranged in unequally spaced relationship on the upper surface of a thin rigid clear or colored light transmissive planar support sheet of methyl methacylate, to form a desired decorative pattern. A light transmissive bonding agent such as methaline dichloride is introduced in a thin stream along the lower edges of the methyl methacylate pieces such that the bonding agent is drawn partially beneath the colored pieces and bonds them to the underlying support sheet to form a substantially integral structure. In a preferred embodiment, the bonding agent is introduced such that each member is bonded to the support sheet only around its outer periphery creating a central void or air space which significantly enhances the insulating qualities of the panel.

A thermally non-conductive opaque binder such as latex grouting having thermal expansion characteristics substantially the same as the methyl methacylate pieces is spread over the top of the assembly to completely fill the areas between the pieces. While the grouting is still in a fluid state, the excess grouting is removed from the upper surface of the panel to expose the upper surfaces of the colored pieces. Furthermore, the excess grouting is removed in such a way that the grouting material remaining in the spaces between the pieces is at a slightly lower level than the upper surface of the pieces, so that the pieces protrude slightly from the grouting.

The upper surfaces of the colored pieces may be further treated with a stain or dye to enhance the decorative effect. Alternatively, light refracting or reflecting members or bits may be added to the upper surface of the colored pieces to further enhance the decorative appearance of the panels.

In another embodiment of the present invention, a thin light transmissive film bearing a decorative photographic or photographic-like image may be laminated as an integral part of the mosaic panel to provide further aesthetically pleasing effects.

Further features of the invention will become apparent from the detailed description which follows:

BRIEF DESCRIPTION OF THE DRAWING

FIG. 1 is a partially completed and cutaway front elevation view of the decorative simulated stained glass light transmissive mosaic panel of the present invention.

FIG. 2A is an enlarged fragmentary cross sectional view of a partially completed simulated stained glass panel illustrating bonding the irregularly shaped members to the planar support sheet.

FIG. 3 is an enlarged fragmentary cross sectional view of a partially completed panel illustrating the excess grouting being removed.

FIG. 4 is an enlarged fragmentary cross sectional view of a first embodiment of a completed panel.

FIG. 5 is an enlarged fragmentary cross sectional view of a second embodiment of a completed panel.

DETAILED DESCRIPTION

The decorative simulated stained glass light transmissive mosaic panel of the present invention is shown generally at 1 in FIG. 1. For purposes of an exemplary showing, panel 1 is generally rectangular in shape, and includes a plurality of unequally spaced irregularly shaped plate-like rigid members, one of which is shown at 2 positioned so as to form a desired decorative pattern. Members 2 may be of different colors to enhance the aesthetic appearance of panel 1, and may be constructed of any suitable light transmissive material. In a preferred embodiment, irregularly shaped colored pieces of methyl methacylate have been used to create the decorative pattern which gives the completed panel certain desirable physical characteristics as will be described in more detail hereinafter. Each individual member 2 may be provided with a rough or irregular upper surface *2a*, or a smooth planar upper surface *2b*, depending on the specific decorative effect to be attained.

Initially, a suitable decorative design may be outlined as at *1a* on paper, newsprint, cloth or the like *1b*, with the intended color of each outlined designed portion designated as desired. A thin rigid clear or colored light transmissive planar support sheet 3 of methyl methacylate, or the like, is then positioned overlying the design sheet such that the design outlines and indicated colors may be viewed through the support sheet 3.

The individual colored members 2 may then be arranged in unequally spaced relationship on the upper surface of the support sheet according to the underlying design pattern. It will be observed that this technique permits the completed mosaic to be fabricated by relatively unskilled personnel such as handicapped or retired persons. Furthermore, the process lends itself to kit or craft-type applications for assembly by hobbyists and the like. As illustrated in FIG. 2A, the upper surface 3*a* of planar support sheet 3 may be smooth and planar to cooperate with the smooth lower surface 2*c* of each of the colored members 2. Alternatively, one or both of these abutting surfaces may be irregular or rough depending on the specific desired visual effect and to enhance the insulating qualities of the panel as described hereinafter.

Figure 2B:
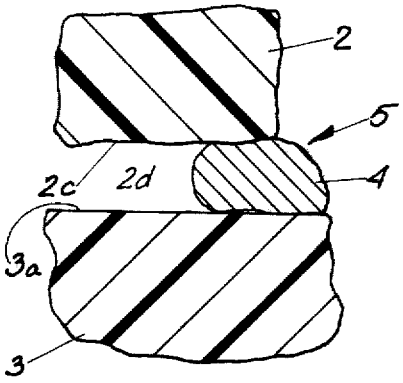
FIG. 2B is an enlarged fragmentary cross sectional view of FIG. 2A.
Figure 2C:
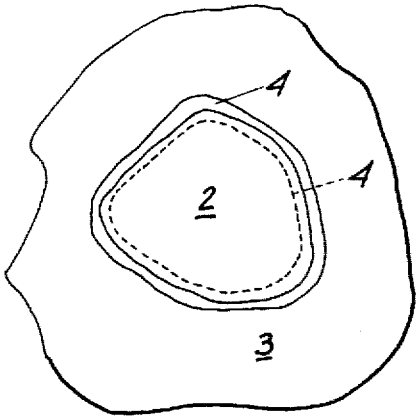
FIG. 2C is a fragmentary top plan view of FIG. 2A.

Each individual member 2 is bonded to the underlying support sheet 3 by a light transmissive bonding agent 4 such as methaline dichloride, methaline chloride, or PS-30 adhesive manufactured by Cadillac Plastic and Chemical Co., 3818 Red Bank Road, Cincinnati, Oh., 45227. In a preferred method of fabricating panel 1, a thin stream of the fluid bonding agent is introduced at the lower edges of the colored members 2 as at 5 by means of a syringe 6, eye dropper or the like, such that the bonding agent is drawn by means of capillary action beneath the members to securely bond the members 2 to the underlying support sheet 3. It will be understood that with the preferred embodiment described, the methaline dichloride bonding agent acts as a solvent, causing fusion to occur between the colored members 2 and the support sheet 3, thereby creating a unitary structure. As best shown in FIG. 2B, the quantity of bonding agent 4 introduced at the interface of the colored members 2 and support sheet 3 is such that the bonding agent is only drawn partly beneath the colored members 2, thereby bonding the members to the support sheet only around their outer periphery. To enhance this effect, the lower surfaces 2*c* of the colored members 2 are roughened or irregular, and the upper surface 3*a* of support sheet 3 is relatively smooth. As best shown in FIG. 2B and FIG. 2C bonding agent 4 is drawn partly under the outer periphery of the colored pieces 2, creating a central void or air space 2*d* between the colored members 2 and support sheet 3. It has been found that this central void or air space 2*d* significantly improves the thermal insulating qualities of the mosaic panel 1, permitting it to be used as a window or in other applications where a thermally insulating light transmissive member is required. It will be understood that bonding agent 4 may be applied between colored members 2 and support sheet 3 in other ways to create central void or air space 2*d*, or the bonding agent 4 may be spread completely between the colored members and the support sheet in installations where additional strength is required but thermal insulation is less critical.

A layer of opaque thermally non-conductive binding material 7 having substantially the same thermal properties as members 2 is spread over the upper surfaces of the members so as to completely fill the gaps or areas between individual members 2, as best shown in FIG. 3. It has been found that the use of a latex grouting for binding material 7 such as Hydrament Ceramic Grout manufactured by UPCO Company, Bostic Chemical Group, or Color Tile Latex Grout manufactured by Tandy Craft provides excellent results. Both of these materials are substantially thermally non-conducting, so that the heat insulating properties of panel 1 are greatly improved for use as a window or the like. Furthermore, since the thermal characteristics of the ceramic grouting material closely approximate the thermal characteristics of the individual colored pieces 2, cracking or separation of the binding material at the boundary between the grouting and the colored pieces, which has heretofor occurred with some types of simulated stained glass windows as a result of temperature changes, is no longer a problem. Consequently, the improved panel of the present invention can be used in locations subject to wide temperature variations.

As best illustrated in FIG. 3, the excess grouting 7 is removed from the upper surface of the panel by means of a scraper 8 or the like to expose the upper surfaces of members 2. It will be observed that grouting 7 is removed in such a way that the upper surface of the grouting 9 remaining between members 2 is at a slightly lower level than the upper surfaces of the members, thereby causing the upper members to protrude slightly from the grouting filling the intervening gaps or channels. If desired, any residual grouting material remaining on the upper surfaces of the individual members may be removed while the grouting is still in a fluid state.

It will be observed that the decorative panel 1 fabricated by the foregoing procedure forms a rigid, thermally insulating structure having clearly defined light transmitting and light blocking areas forming a pleasing stained glass-like effect which can be used directly as a window or the like. The thermal properties of the structure prevent heat transfer and consequently provide improved performance over conventional stained glass windows where heat may be lost through the lead filling material. Furthermore, since the completed structure permits a small degree of flexing or bending, as a result of the physical characteristics of the grouting and planar support sheet, the panels can be used for large installations without the need for additional support or strengthening members such as metallic bars or the like. Finally, inasmuch as the individual colored members need not be accurately shaped to fit within specifically defined areas in a structural matrix as in conventional stained-glass window constructions, all of the colored members may be utilized, thereby eliminating scrap material.

As noted, panels 1 may be used as described, or with the additional features illustrated in FIG. 4. In this embodiment, one or more of members 2 may be provided with a groove or indentation 10, dimensioned to accept an additional light reflecting or refracting piece 11 such as a small prism, mirror, etc. Alternatively, a plurality of spherical-like light transmissive pieces 12 may be stacked atop one or more of colored members 2, and held in place by suitable bonding agents such as that described hereinabove, to provide additional light reflecting or refracting characteristics to the completed panel.

In the embodiments of FIG. 5, one or more of colored members 2 may be provided with a suitable stain or dye 13 to modify the color characteristics of the associated colored member. In a preferred embodiment, an oil pigment of the desired color is mixed with a vehicle such as Winsor and Newton Liquin, or other durable non-yellowing oil painting medium based on an oil modified synthetic resin, which allows the pigment to become transparent or semi-transparent. The resulting dye 13 may then be brushed or sprayed on the surface of the mosaic panel 1 to alter the existing colors of the colored members 2 and more clearly define the design. In general, only primary colors will be used, with the thin layers of colored dye 13 acting as filters to modify the light passing through the panel. For purposes of a preferred embodiment, the primary colors used in this light mixing technique are orange (napthalene carboxylic acid pigment), green (azomethine pigment) or phthalo green (halogenated copper phtalo-cynine), and blue, french-ultramarine (sodium thio alumino silicate).

After the desired dye colors have been applied, a thin coat of synthetic varnish such as Letraset hard surface protective coating, manufactured by Letraset, Inc., may be applied over the entire surface of the mosaic panel to permanently encapsulate the color and protect it from dust, dirt and wear. Alternatively, particularly for applications requiring a relatively smooth upper surface for panel 1, such as might be encountered with dance floors and the like, the completed structure may be provided with a light transmissive covering 14 of methyl methacylate having a smooth upper surface.

As an example of this mixing process, a yellow colored member covered with a thin layer of blue dye will produce an apparent green color for that portion of the mosaic design. Consequently, fewer numbers of differently colored members may be utilized, with a portion of the design being supplied by the choice of dyes applied to the mosaic surface.

Figure 6:
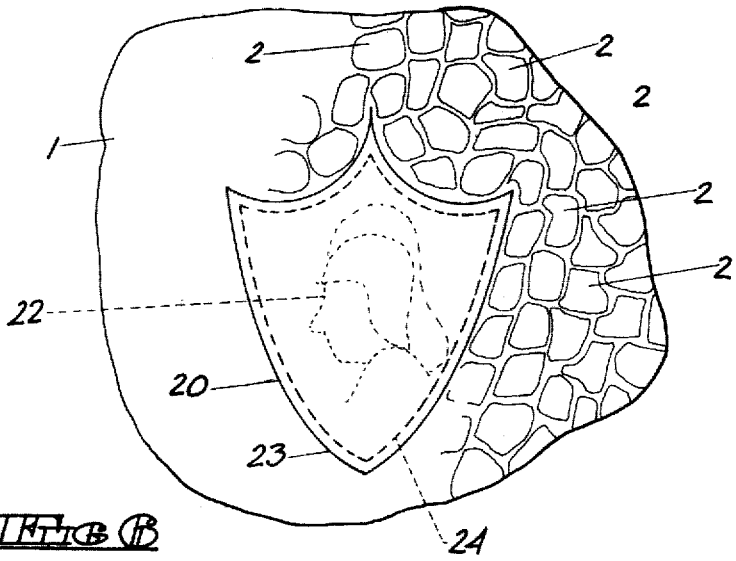
FIG. 6 is a fragmentary top plan view of another embodiment of the present invention.
Figure 7:
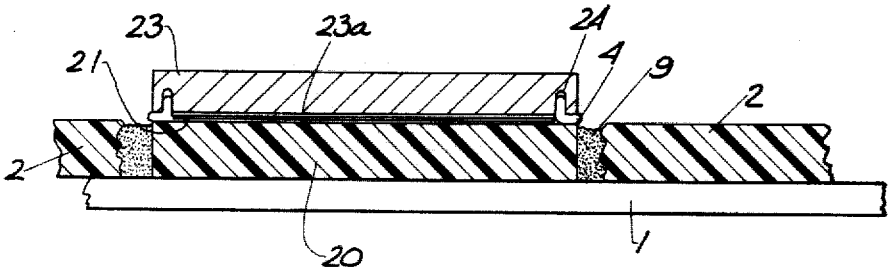
FIG. 7 is an enlarged fragmentary cross sectional view of the embodiment of FIG. 6.

Another embodiment of the present invention is illustrated in FIG. 6 and 7. In this arrangement, colored members 2 are bonded to support sheet 1, and joined by an appropriate grouting material 9 as described hereinabove in connection with the embodiment of FIG. 1–FIG. 5. In addition, an auxiliary colored or clear methyl methacylate member 20, formed in a desired shape such as a shield or the like, is bonded to support sheet 1 using the technique described hereinabove. Grouting 9 may then be added to join the auxiliary member 20 to the adjoining colored members 2 in a manner similar to that described hereinabove in connection with FIG. 3. Following the removal of the excess grouting material, a thin transparent or semi-transparent film 21 bearing a photographic image 22 of the same or slightly smaller dimensions than auxiliary member 20 is placed on the upper surface of member 20 such that the photographic image may be observed through the mosaic panel 1. The image may be formed in a continuous tone, a positive line image, or a negative line image, and may be in color, sepia, black and white or other well recognized photographic technique, depending on the particular aesthetic effect desired. A top sheet 23 of approximately the same shape and dimensions as member 22 is laminated on top of film 21 to seal the film firmly in place. Top sheet 23 is provided on its underside with a peripheral groove 24 inset slightly from the outer edge of the sheet. Top sheet 23 is joined to either auxiliarly member 20 or film 21 or both by a thin stream of bonding agent 4 introduced along the outer periphery of the junction of these members as described hereinabove. Peripheral groove 24 prevents the bonding agent from spreading beyond the groove, and interfering with or otherwise obscuring the photographic image on film 21. Alternatively, depending on the aesthetic effect desired, the lower surface 23a of top sheet 23 may be provided with a roughened or irregular surface in order to limit the spread of the bonding agent. In either event, a thin film of bonding agent 4 will be provided around the outer periphery of top sheet 23, securely bonding it to the underlying film or auxiliary member or both, and leaving a central void or air space between top sheet 23 and auxiliary member 20 to provide additional insulating ability. In general, top sheet 23 will be constructed of a transparent or semi-transparent clear or colored material such that the photographic image 22 may be clearly discerned through the mosaic panel.

It will be understood that various changes in the details, materials, steps and arrangements of parts, which have been herein described and illustrated in order to explain the nature of the invention, may be made by those skilled in the art within the principle and scope of the invention as expressed in the appended claims.

The embodiments of the invention in which an exclusive property or privilege is claimed are as follows:

1. A decorative simulated stained glass light transmissive mosaic panel comprising:

a thin rigid light transmissive planar support sheet of methyl methacylate having a generally smooth planar upper surface;

a plurality of unequally spaced irregularly shaped plate-like rigid light transmissive colored members of methyl methacylate positioned on said surface of said sheet to form a desired decorative pattern; and a thermally non-conductive opaque bonding material comprising a latex grouting, said grouting having thermal expansion properties substantially the same as said members, completely filling the areas between said members and extending no lower than said sheet surface such that the upper surfaces of said members are exposed, whereby light may be transmitted through said panel to form a pleasing stained glass-like effect.

2. The decorative panel according to claim 1 wherein said bonding material fills the areas between said members to a level slightly lower than the upper surfaces of said members.

3. The decorative panel according to claim 1 including a bonding agent bonding said members to said sheet.

4. The decorative panel according to claim 3 wherein said bonding agent is light transmissive.

5. The decorative panel according to claim 3 wherein said bonding agent is arranged only around the periphery of said members to form a central void between said member and said support sheet.

6. The decorative panel according to claim 3 including means for containing said bonding agent around the outer periphery of said members to create a central void between said member and said support sheet.

7. The decorative panel according to claim 6 wherein said means comprises an irregular lower surface of said member.

8. The decorative panel according to claim 1 including an auxiliary plate-like light transmissive rigid member of methyl methacylate positioned on said sheet and a thin light transmissive image bearing film overlying said auxiliary member.

9. The decorative panel according to claim 8 including a thin light transmissive top plate overlying said film.

10. The decorative panel according to claim 9 including a bonding agent securing said top plate to said auxiliary member.

11. The decorative panel according to claim 10 including means for preventing the spread of said bonding agent to the image bearing portion of said film.

12. The decorative panel according to claim 11 wherein said means comprises a groove inscribed around the periphery of said top plate.

13. The decorative panel according to claim 1 including a layer of light transmissive colored dye overlying the upper surface of one or more of said members.

14. The decorative panel according to claim 1 including a light transmissive planar sheet of methyl methacylate overlying the upper surface of said panel.

15. A decorative simulated stained glass light transmissive mosaic panel comprising:

a thin rigid light transmissive planar support sheet of methyl methacylate having a generally smooth planar upper surface;

a plurality of unequally spaced irregularly shaped plate-like rigid light transmissive colored members of methyl methacylate positioned on said surface of said sheet to form a desired decorative pattern; and a light transmissive bonding agent adhesively bonding said members to said sheet, and means for containing said bonding agents around the outer periphery only of said members to form a central area devoid of bonding agent between each of said members and said support sheet.

16. The decorative panel according to claim 15 including a thermally non-conductive bonding agent material having thermal expansion properties substantially the same as said members completely filling the areas between said members such that the upper surfaces of said members are exposed, whereby light may be transmitted through said panel to form a pleasing stained glass-effect.

17. The decorative panel according to claim 16 wherein said bonding material fills the areas between said members to a level slightly lower than the upper surfaces of said members.

18. The decorative panel according to claim 15 wherein said means comprises an irregular lower surface of said member.

* * * * *